US007497256B2

(12) United States Patent
DiFoggio et al.

(10) Patent No.: US 7,497,256 B2
(45) Date of Patent: Mar. 3, 2009

(54) METHOD AND APPARATUS FOR COLLECTING FLUID SAMPLES DOWNHOLE

(75) Inventors: Rocco DiFoggio, Houston, TX (US); Leroy W. Ledgerwood, III, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/450,774

(22) Filed: Jun. 9, 2006

(65) Prior Publication Data

US 2007/0284099 A1 Dec. 13, 2007

(51) Int. Cl.
*E21B 49/06* (2006.01)
*E21B 49/10* (2006.01)

(52) U.S. Cl. ..... 166/264; 166/100; 166/169

(58) Field of Classification Search ..... 166/55.1, 166/100, 169, 250.17, 264; 175/50, 59; 73/152.23, 152.24, 152.26, 152.51, 152.62
See application file for complete search history.

(56) References Cited

U.S. PATENT DOCUMENTS

| | | | | | |
|---|---|---|---|---|---|
| 2,389,512 | A * | 11/1945 | Humason | 166/100 |
| 2,905,247 | A * | 9/1959 | Vestermark | 166/100 |
| 3,530,933 | A * | 9/1970 | Whitten | 166/100 |
| 3,864,970 | A * | 2/1975 | Bell | 73/152.25 |
| 3,934,468 | A * | 1/1976 | Brieger | 73/152.25 |
| 4,416,152 | A * | 11/1983 | Wilson | 73/152.26 |
| 5,230,244 | A * | 7/1993 | Gilbert | 73/152.17 |
| 6,164,126 | A * | 12/2000 | Ciglenec et al. | 73/152.01 |
| 6,301,959 | B1 * | 10/2001 | Hrametz et al. | 73/152.23 |
| 6,388,251 | B1 * | 5/2002 | Papanyan | 250/269.1 |
| 6,926,595 | B2 | 8/2005 | Pollak et al. | |
| 6,964,301 | B2 | 11/2005 | Hill et al. | |
| 6,968,910 | B2 | 11/2005 | Bar-Cohen et al. | |
| 7,090,012 | B2 | 8/2006 | Hill et al. | |
| 7,152,466 | B2 * | 12/2006 | Ramakrishnan et al. | 73/152.51 |
| 2002/0043371 | A1 | 4/2002 | Hewlett et al. | |
| 2002/0060067 | A1 | 5/2002 | Bolze et al. | |
| 2002/0084072 | A1 | 7/2002 | Bolze et al. | |
| 2002/0129937 | A1 | 9/2002 | Cravatte | |
| 2003/0042021 | A1 | 3/2003 | Bolze et al. | |
| 2003/0085035 | A1 | 5/2003 | Kurkjian et al. | |
| 2004/0000433 | A1 | 1/2004 | Hill et al. | |
| 2004/0020649 | A1 | 2/2004 | Fields | |
| 2004/0129070 | A1 | 7/2004 | Bolze et al. | |
| 2004/0173351 | A1 | 9/2004 | Fox et al. | |
| 2005/0028974 | A1 | 2/2005 | Moody | |
| 2005/0082059 | A1 | 4/2005 | Nogueira et al. | |
| 2005/0155760 | A1 | 7/2005 | Hill et al. | |
| 2005/0194134 | A1 | 9/2005 | McGregor et al. | |
| 2005/0205256 | A1 | 9/2005 | DiFoggio | |

(Continued)

*Primary Examiner*—Jennifer H Gay
*Assistant Examiner*—Daniel P Stephenson
(74) *Attorney, Agent, or Firm*—G. Michael Roebuck

(57) ABSTRACT

In one embodiment an apparatus is disclosed that includes a tool in a wellbore. A probe is extendable from the tool to contact a wall of a formation surrounding the wellbore. A tube substantially surrounds the probe wherein the tube is extendable into the formation surrounding the wellbore. In another embodiment a method for reducing contamination of a sample of a formation fluid is disclosed that includes extending a probe to contact a wall of a formation. A barrier tube that substantially surrounds the probe is extended into the formation thereby restricting a flow of a contaminated reservoir fluid that would otherwise come from near-wellbore regions above and below the probe from going toward the probe.

21 Claims, 4 Drawing Sheets

U.S. PATENT DOCUMENTS

2005/0279499 A1 12/2005 Tarvine et al.
2005/0284629 A1 12/2005 Reid et al.
2006/0000603 A1* 1/2006 Zazovsky et al. ..... 166/244.1
2006/0021796 A1 2/2006 Moran
2006/0075813 A1 4/2006 Fisseler et al.
2006/0090894 A1 5/2006 Seeberg-Elverfeld et al.
2006/0137873 A1 6/2006 Caudwell et al.

* cited by examiner

METHOD AND APPARATUS FOR COLLECTING FLUID SAMPLES DOWNHOLE

BACKGROUND OF THE INVENTION

1. Field of the Invention

The present invention relates to the field of downhole formation testing.

2. Background Information

Oil and gas companies spend large sums of money to find hydrocarbon deposits. Oil companies drill exploration wells in their most promising prospects and use these exploration wells, not only to determine whether hydrocarbons are present but also to determine the properties of those hydrocarbons, which are present.

To determine hydrocarbon properties, oil and gas companies often withdraw some hydrocarbons from the well. Wireline formation testers can be lowered into the well for this purpose. Initially, fluids that are withdrawn may be highly contaminated by filtrates of the fluids ("muds") that were used during drilling. To obtain samples that are sufficiently clean (usually <10% contamination) so that the sample will provide meaningful lab data concerning the formation, formation fluids are generally pumped from the wellbore for 30-90 minutes, while clean up is being monitored in real time. For some properties, samples can be analyzed downhole in real time. The present invention relates both to monitoring sample clean up and to performing downhole analysis of samples at reservoir conditions of temperature and pressure. A downhole environment is a difficult one in which to operate a sensor. Measuring instruments in the downhole environment must operate under extreme conditions and limited space within a tool's pressure housing, including elevated temperatures, extreme vibration, and shock.

SUMMARY OF THE INVENTION

In a particular embodiment an apparatus is disclosed. The apparatus includes a tool positioned in a wellbore, a probe extendable from the tool to contact a wall of a formation surrounding the wellbore, and a tube substantially surrounding the probe wherein the tube is extendable into the formation surrounding the wellbore.

In one aspect of the present invention, a tool is provided for traversing a wellbore. A probe is extendable from the tool to contact a wall of a wellbore drilled into a formation surrounding the wellbore. The tool further includes a tube which substantially surrounds the probe wherein the tube is extendable into the wall of the wellbore and into the formation surrounding the wellbore.

In another aspect, a method for reducing contamination of a sample of a formation fluid is disclosed including extending a probe to contact a wall of a formation. A barrier tube that substantially surrounds the probe is extended into the formation thereby restricting a flow of a contaminated reservoir fluid toward the probe.

In another particular embodiment the formation comprises an unconsolidated formation. In another particular embodiment the apparatus further includes a pump hydraulically coupled to the probe and in fluid communication with the formation. In another particular embodiment the apparatus further includes a drive system in mechanical communication with the tube. In another particular embodiment the apparatus wherein the drive system further comprises a linear drive system to push the tube into the formation. In another particular embodiment the drive system includes a rotary drive system acting cooperatively with a linear drive system to enhance extension of the tube into the formation. In another particular embodiment the apparatus wherein the tube has a shaped end to enhance penetration into the formation.

In another particular embodiment the apparatus further includes a vibratory source coupled to the barrier tube to enhance penetration of the barrier tube into the formation. In another particular embodiment the tool is conveyed into the wellbore by a wireline, a coiled tubing, or a drill string. In another particular embodiment the apparatus further includes a sensor in the tool detecting fluid contamination. In another particular embodiment the apparatus wherein the sensor is chosen from the group consisting of: a fluid density sensor, an acoustic sensor, and an optical sensor spectrometer. In another particular embodiment the apparatus further includes a sensor in the tool detecting contamination of a fluid sample and a controller acting under programmed instructions to extend the barrier tube into the formation based on the detected contamination of the fluid sample.

In a particular embodiment a method is disclosed for reducing contamination of a sample of a formation fluid. The method includes extending a probe to contact a wall of a formation and extending a barrier tube that substantially surrounds the probe into the formation thereby restricting a flow of a contaminated formation fluid toward the probe. In another particular embodiment the method further includes sensing a parameter of interest related to contamination of a sample fluid drawn into the tool. In another particular embodiment the method further includes controlling the extension of the tube into the formation in response to the sensed contamination. In another particular embodiment the method further includes vibrating the tube to enhance penetration into the formation.

In another particular embodiment the method further includes shaping an end of the tube to enhance penetration into the formation. In another particular embodiment the method further includes rotating the tube to enhance penetration into the formation. In another particular embodiment the method further includes conveying the tool into the wellbore using at least one of: a wireline, a coiled tubing, and a drill string.

Examples of certain aspects of the invention have been summarized here rather broadly in order that the detailed description thereof that follows may be better understood and in order that the contributions they represent to the art may be appreciated. There are, of course, additional features of the invention that will be described hereinafter.

BRIEF DESCRIPTION OF THE FIGURES

For a detailed understanding of the present invention, references should be made to the following detailed description of the exemplary embodiment, taken in conjunction with the accompanying drawings, in which like elements have been given like numerals, wherein.

DETAILED DESCRIPTION

Figure 1:
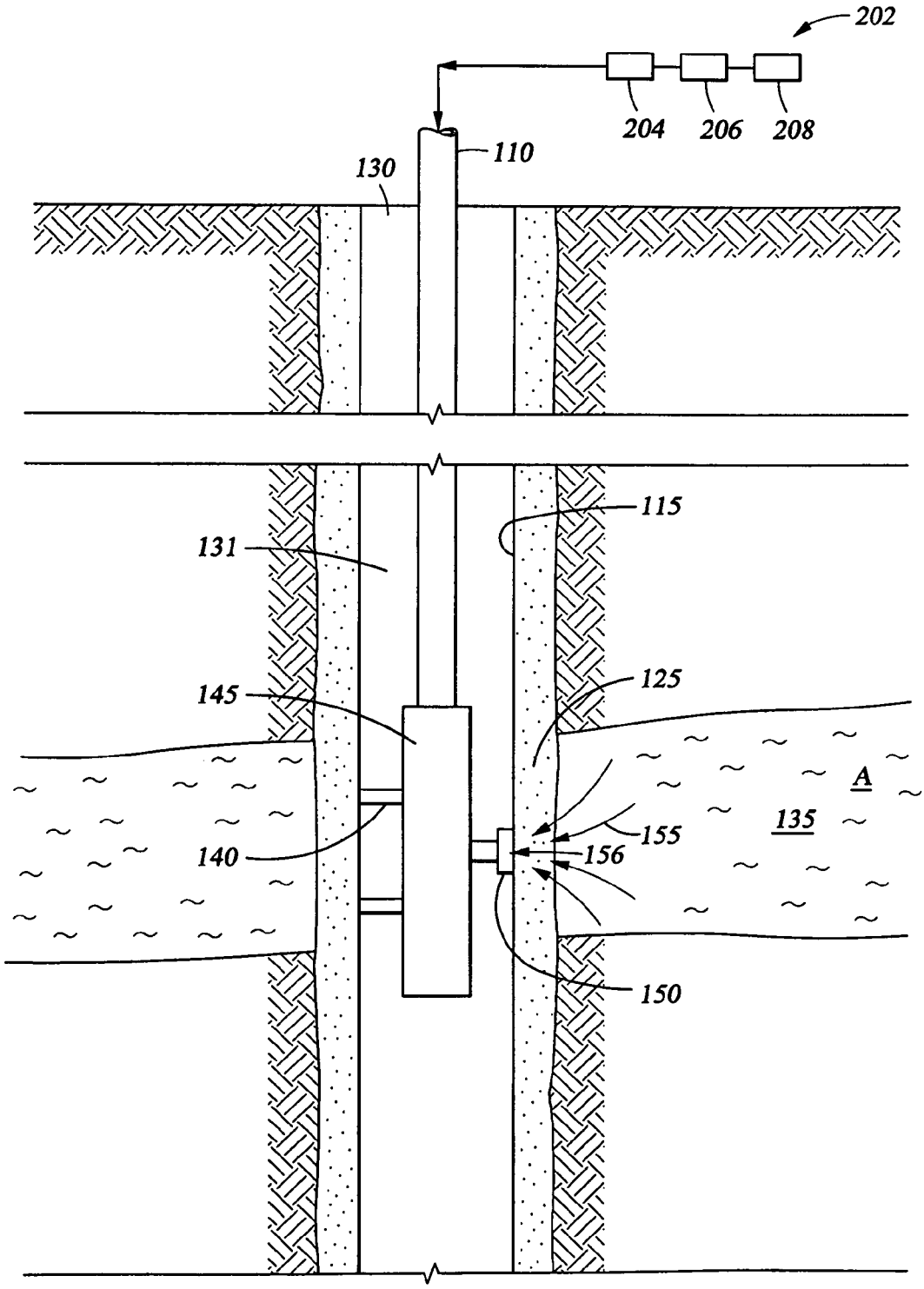
FIG. 1 shows an illustrative embodiment of a formation deployed in a downhole environment.

FIG. 1 shows an illustrative embodiment of the present invention deployed in borehole 130 that passes through formation zone "A". Formation zone "A" has a formation fluid 155 therein. Borehole 130 has working fluid 131 therein. Working fluid 131 may be a drilling fluid, a completion fluid, or any other suitable fluid as used in well drilling and completion. In one embodiment, formation zone "A" may comprise an unconsolidated formation having an invaded region 125 and an un-invaded region 135. As used herein, an unconsolidated formation comprises sediment not cementitiously bonded together, and may consist of sand, silt, clay, and organic material.

Working fluid 131 may invade the formation surrounding a wellbore, with the invasion depth being variable. Fluid 156 in invaded zone 125 may be a contaminated mixture of formation fluid 155 from un-invaded region 135 and working fluid 131. As used herein, formation fluid means fluid that is substantially un-contaminated by fluid invasion from the wellbore. Formation fluid 155 may comprise water and/or hydrocarbon fluids. Formation hydrocarbon fluids may include hydrocarbon liquids and/or hydrocarbon gases of various compositions. Formation fluid 155 may be connate formation fluid. As used herein, connate formation fluid is formation fluid trapped in the formation at the time of the forming of the formation.

As shown in FIG. 1, in one non-limiting embodiment, downhole tool 145 is deployed in borehole 130 on member 110. Deployment member 110 may be a wireline, slick line, drill string, or coiled tubing. Downhole tool 145 may be a formation test tool for retrieving a sample of formation fluid 155 from formation "A". Any suitable fluid sampling tool is intended to be encompassed by the present invention. Surface controller 202 is in data and/or power communication with downhole tool 145. Surface controller 202 includes communication system 204 in communication with processor 206 and an input/output device 208. The input/out device 208 may be a typical terminal for user inputs. A display such as a monitor or graphical user interface, not shown, may be included for real time user interface. When hard-copy reports are desired, a printer may be used. Storage media such as CD, DVD, tape, disk, or any other suitable storage media may be used to store data retrieved from downhole for future analyses. Processor 206 may be used for encoding commands to be transmitted downhole and for processing decoding data received from downhole via communication system 204. In addition, processor 206 may be used for analyzing the data received from downhole. Surface communication system 204 may include a receiver for receiving data transmitted from downhole and transferring the data to processor 206 for evaluation, recording, and display. A transmitter may also be included with communication system 204 to send commands to the downhole components. Data may be transmitted between the surface and downhole tool using any suitable transmission scheme. The transmission scheme may be dependent on the type of deployment method used. Transmission schemes include, but are not limited to: hardwire telemetry, mud pulse telemetry, acoustic telemetry, and electromagnetic telemetry.

As also shown in FIG. 1, downhole tool 145 has extendable probe 150 and opposing anchor arms 140. Extendable probe 150 is extendable to contact wall 115 of borehole 130. A sample of fluid is extracted from formation zone "A". As shown in FIG.1, both formation fluid 155 and contaminated fluid 156 flow toward probe 150 possibly resulting in the extraction of a contaminated sample.

Figure 2:
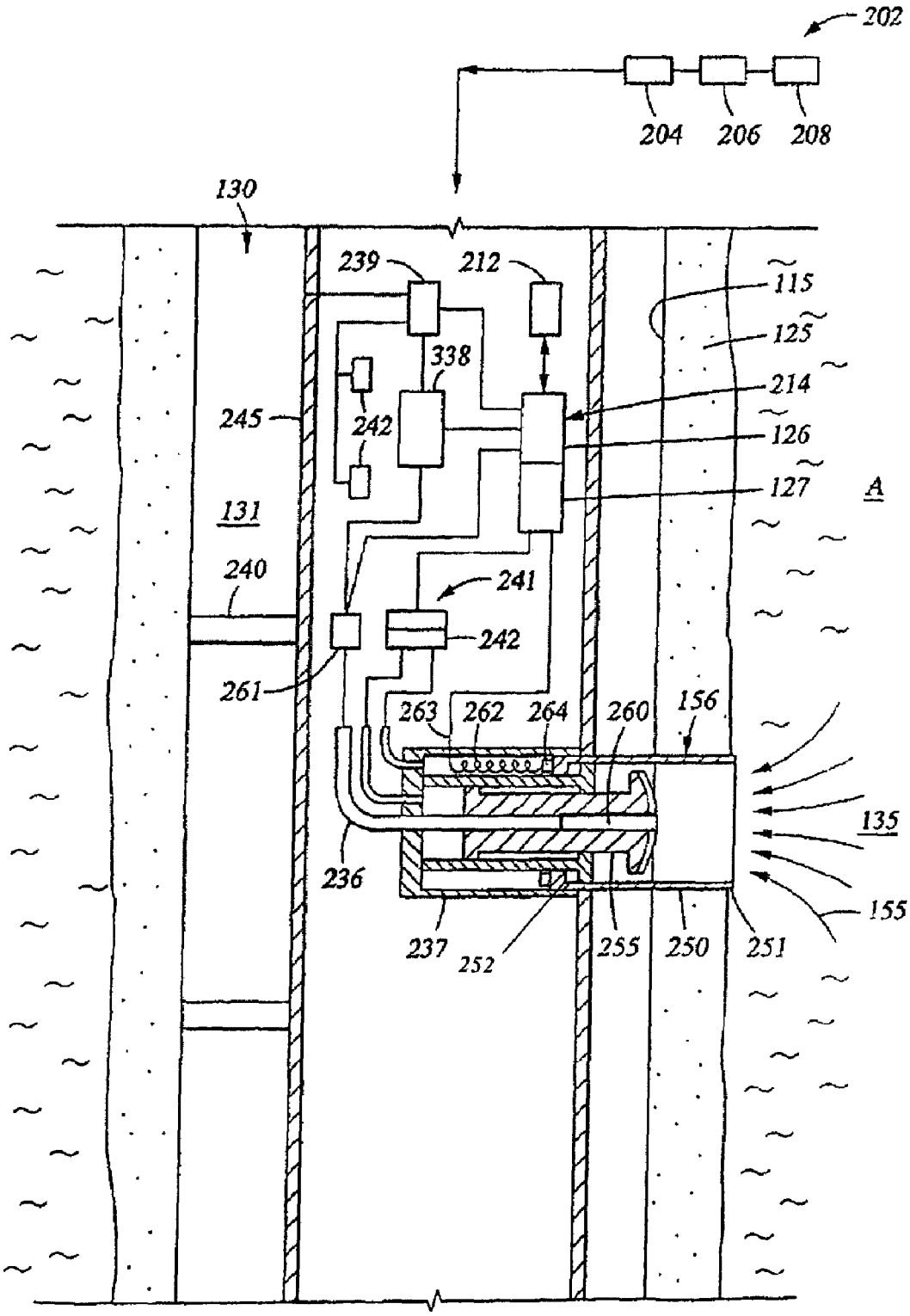
FIG. 2 shows a non-limiting illustrative embodiment of a cross section of a formation test tool acquiring a sample and having a barrier tube penetrating a formation.

FIG. 2 shows another illustrative embodiment of a downhole tool 245 that may comprise a formation tester. As shown in FIG. 2, downhole tool 245 comprises communication and power unit 212 and includes a transmitter and receiver for two-way communication with the surface controller 202 using transmission schemes similar to those previously described. Connected to the communication and power unit 212 is downhole controller 214. In one embodiment, downhole controller 214 comprises processor 126 and memory 127. Downhole controller 214 may use commands stored in downhole controller 214, surface-initiated commands, or a combination of the two to control the downhole components.

As shown in FIG. 2, probe 255 extends to wall 115 of borehole 130 that has working fluid 131 therein. Probe 255 has flow passage 260 for extracting a sample of formation fluid 155 from formation zone "A". A sample of formation fluid is drawn through flow passage 260 and through flow line 236 by pump 338. Pump 338 discharges fluid samples to valve assembly 239. Valve assembly 239 may be actuated by controller 214 to direct the fluid sample to sample chamber 242. Sample chamber 242 may comprise multiple sample chambers for taking multiple samples in one downhole deployment. Samples may also be taken at multiple depths in other formation zones of interest. Contaminated fluid samples may be diverted to borehole 130.

A sensor 261 in line 236 may detect a parameter of interest of the fluid sample related to the level of contamination in the fluid sample. Such a parameter of interest may include, but is not limited to: sample fluid density; sample fluid resistivity; sample fluid acoustic velocity; sample fluid optical emission spectra; and sample fluid optical transmission spectra. Examples of sensor 261 include, but are not limited to: a fluid density sensor, an acoustic sensor, and an optical sensor and optical spectrometer. Sensor 261 may comprise a suite of sensors measuring several of the indicated parameters of interest. Signals from sensor 261 may be used by downhole controller 214 to determine when a fluid sample is sufficiently un-contaminated for collection and/or further downhole analysis. In one embodiment, downhole controller 214 acts according to programmed instructions and cooperatively with sensor 261 to determine when a fluid sample is suitable for collection, and actuates valve assembly 239 to divert the fluid sample to sample chamber 242. Alternatively, signals from sensor 261 may be transmitted to surface controller 202 which then analyzes the fluid sample and directs the collection of fluid samples downhole.

As further shown in FIG. 2, barrier tube 250 substantially surrounds probe 255. Barrier tube 250 is extendable into formation zone "A". In one non-limiting embodiment, barrier tube 250 and probe 255 are arranged in a substantially concentric arrangement, as shown in FIG. 2. Barrier tube 250 may be extended by any drive system suited for providing a force sufficient for extending barrier tube 250 into formation zone "A". Drive systems suitable for such a task include, but are not limited to, a hydraulic system, a mechanical gear driven system, an electro- mechanical system, and an electromagnetic system. In one example, as shown in FIG. 2, hydraulic drive system 241 comprises a hydraulic pump 242 which may be controlled by controller 214. Hydraulic pump 242 provides hydraulic fluid to the appropriate channels in cylinder housing 237 to extend probe 255 and/or barrier tube 250 to their operable positions for taking a fluid sample. The hydraulic pressure from hydraulic pump 242 may be controlled to control the force exerted on probe 255 and barrier tube 250. The end 251 of barrier tube 250 may be shaped to provide more effective penetration of formation zone "A", as discussed below. Alternatively, other drive systems may be used, such as, for example, a ball-screw actuator. Other examples of drive systems include, but are not limited to: a linear motor drive power system, and a solenoid driven power system. Barrier tube 250 may also be rotated during extension using a rotary drive system 252 to facilitate penetration into the formation through the borehole wall.

The extension of barrier tube 250 into formation zone "A" restricts flow of contaminated fluid 156 from invaded region 125 into extended probe 255. As one skilled in the art will appreciate, the thickness of contaminated region 125 is dependent on formation properties and working fluid properties. In some cases, barrier tube 250 may extend entirely through contaminated region 125, as shown in FIG. 2. In this case, substantially all of the flow of contaminated fluid 156 from invaded region 125 may be precluded from entering probe 255 with formation fluid 155. In other cases, the invaded region may extend to a depth deeper than barrier tube 250 can reach. However, even when barrier tube 250 does not extend completely through contaminated region 125, at least a portion of contaminated fluid 156 is restricted from entering probe 255 and contaminating a formation fluid sample.

In another non-limiting embodiment, downhole controller 214 acts cooperatively with sensor 261 to extend barrier tube 250 into formation zone "A" until an acceptably uncontaminated sample is detected by sensor 261, or until barrier tube 250 reaches maximum extension.

In one illustrative embodiment, still referring to FIG. 2, a piezoelectric element 264 is coupled to barrier tube 250. Piezoelectric element 264 couples vibratory motion into barrier tube 250 which may enhance the movement of barrier tube 250 through formation zone "A". Piezoelectric element 264 is connected through conductor 262 to downhole controller 214. Downhole controller 214 may control the activation of piezoelectric element 262 in a feedback loop based on the amount of power required to extend barrier tube 250 into formation zone "A".

Figure 3:
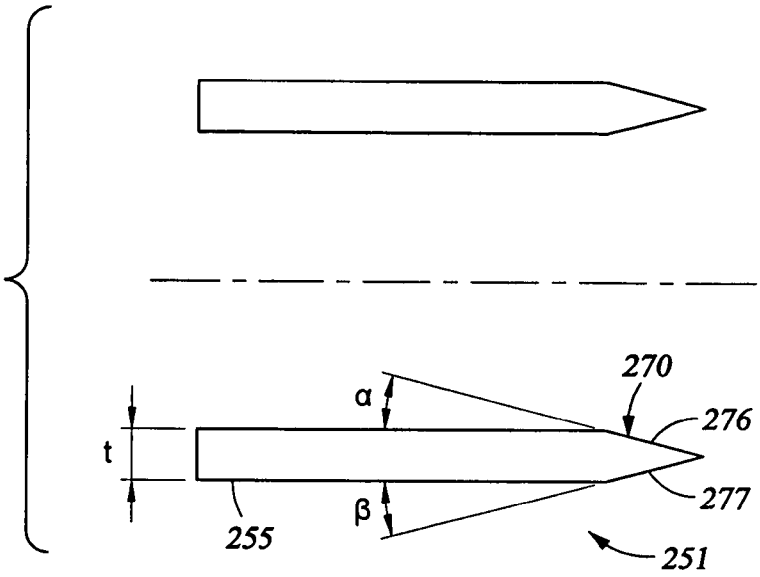
FIGS. 3-5 show non-limiting examples of a penetrating end of a barrier tube.
Figure 4:
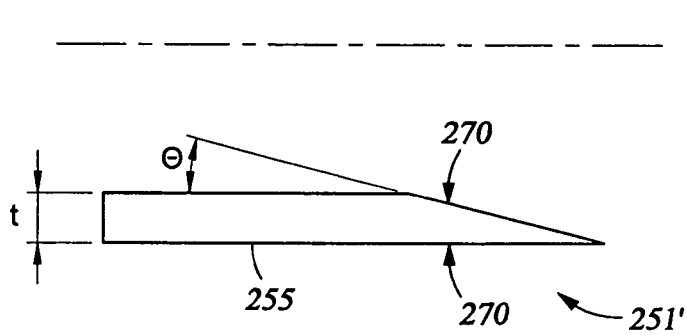
Figure 5:
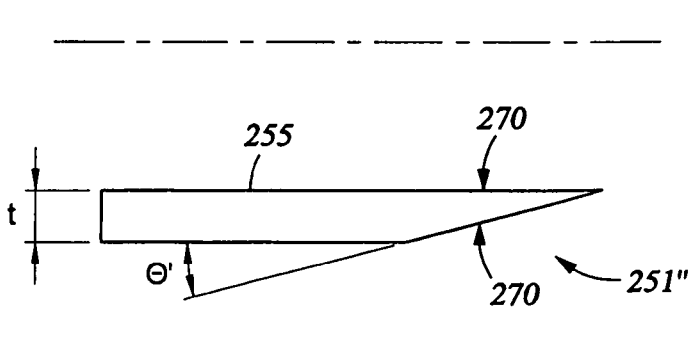
Figure 6:
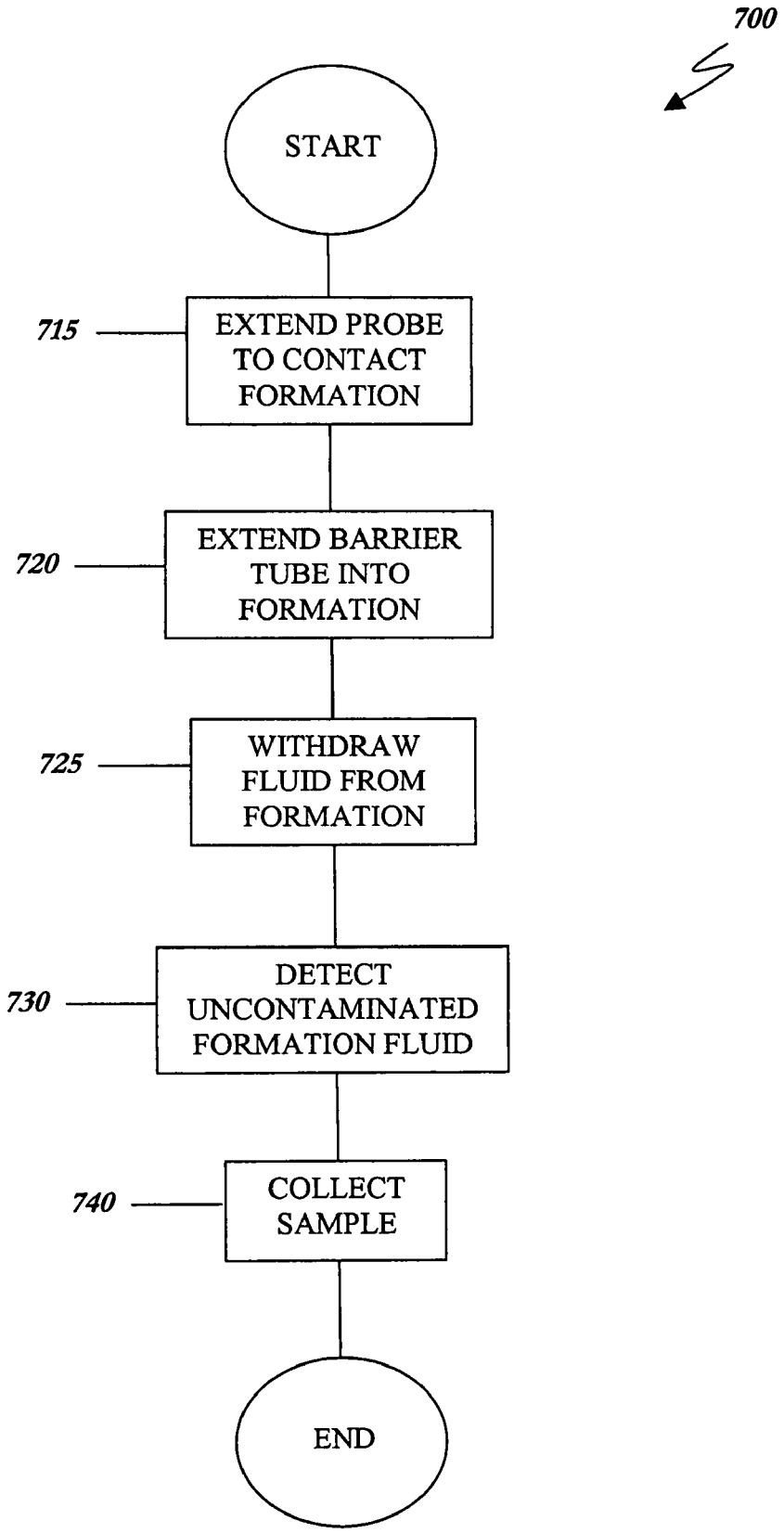
FIG. 6 shows a non-limiting flow chart for collecting formation fluid samples according to in an illustrative embodiment.

Penetration of formation zone "A" is enhanced by shaping end 251 of barrier tube 250 as shown in the non-limiting examples of FIGS. 3-5. FIG. 3 shows end 251 of barrier tube 250 having a contoured end with both an internally beveled surface 276 having an angle, $\alpha$, and an externally beveled surface having an angle, $\beta$. Each of angles $\alpha$ and $\beta$ may have a different value in the range of about 0° to about 45°. The thickness "t" of the wall of barrier tube 255 may be in the range from about 0.13 mm (0.005 in) to about 6.35 mm (0.25 in). The beveled surfaces 276 and 277 may have a hard coating to improve abrasion resistance. Such coating may include, but is not limited: tungsten carbide coating and diamond coating.

FIG. 4 shows another embodiment of end 251' of barrier tube 250. End 251' has a single internal bevel with an angle, $\theta$. Angle $\theta$ has a value in the range from about 0° to about 45°. FIG. 5 shows yet another embodiment of end 251" of barrier tube 250. End 251" has a single external bevel with an angle, $\theta'$. Angle $\theta$ has a value in the range from about 0° to about 45°. While the ends 251, 251', and 251" of barrier tube are shown in FIGS. 3-5 as solid ends, it is contemplated that the present invention also encompass a serrated configuration around the periphery of ends 251, 251', and 251".

Computer simulations were done of the barrier tube concept based on round sand grains having sizes of 0.020 inch to 0.035 inch that were held together by 500 psi of differential pressure. A friction coefficient of 0.3 between the barrier tube wall and the grains was assumed. In this simulation, the grains were not cemented to each other so as to represent an unconsolidated sand. The edge of the barrier tube was beveled like a razor blade. Entry force plots were prepared for barrier tubes having tube wall thickness of 0.010 inch, 0.040 inch and 0.160 inch.

The peak forces for penetration for the different thickness of tube wall were not very different. These peak forces were associated with the tip of the tube edge running into a grain and having to push it out of the way to the side and the force required to do that does not change much with tube wall thickness. Once a blocking grain was out of the way, there was a "background" force for continuing to push the barrier tube into the formation. This background force changes significantly with barrier tube wall thickness. For a 0.010-inch thick tube wall, the background force was around 15 pounds per inch of tube wall edge. For a 0.040-inch thick tube wall, the background force reached about 50 to 70 pounds per inch of tube wall edge. For a 0.160-inch thick tube wall, it was on the order of 400 pounds per inch tube wall edge. The background force increases with tube wall thickness because: (1) friction on the side walls increases because the lateral forces are higher as the wall thickness increases and (2) the thicker walls have to displace a larger volume of grains.

In principle, the thinner the barrier tube wall, the easier the penetration of the formation. However, in practice, a 0.010 inch wall may buckle under load depending on the material of which it is constructed. To reduce the likelihood of buckling, the wall of the tube could be corrugated. A wall thickness in the range of 0.030" to 0.050" range would be stronger without increasing the penetration force too much. The thicker wall barrier tube could also be corrugated for added strength. The barrier tube could optionally be a disposable item that is left in place and not retrieved from the formation.

Turning now to FIG. 7, a flow chart 700 is shown wherein an illustrative embodiment probe is extended to contact a formation at block 715. A barrier tube is extended into the formation at block 720. Fluid is withdrawn from the formation at block 725. Uncontaminated formation fluid is detected at block 730. A formation fluid sample is collected at block 740 and the process ends.

While the foregoing disclosure is directed to the exemplary embodiments of the invention, various modifications will be apparent to those skilled in the art. It is intended that all variations within the scope of the appended claims be embraced by the foregoing disclosure.

What is claimed is:

1. An apparatus for collecting a sample downhole, comprising:

a flow passage extendable up to a formation;

a tube substantially surrounding the flow passage wherein the tube is extendable into the formation; and a vibratory source coupled to the tube to enhance penetration of the tube into the formation.

2. The apparatus of claim 1, wherein the formation comprises consolidated formation.

3. The apparatus of claim 1, further comprising a pump hydraulically coupled to the probe and in fluid communication with the formation.

4. The apparatus of claim 3, further comprising a sensor in the tool detecting fluid contamination.

5. The apparatus of claim 4, wherein the sensor is chosen from the group consisting of: a fluid density sensor, an acoustic sensor, and an optical sensor spectrometer.

6. The apparatus of claim 1, further comprising a drive system in mechanical communication with the tube.

7. The apparatus of claim 6, wherein the drive system further comprises a linear drive system to push the tube into the formation.

8. The apparatus of claim 6, wherein the drive system comprises a rotary drive system acting cooperatively with a linear drive system to enhance extension of the tube into the formation.

9. The apparatus of claim 1, wherein the tube has a shaped end to enhance penetration into the formation.

10. The apparatus of claim 1, wherein the tool is conveyed into the wellbore by at least one of: a wireline, a coiled tubing, a slickline and a drill string.

11. The apparatus of claim 1, wherein sample is a fluid sample.

12. The apparatus of claim 1, wherein the flow passage is a probe extendable up to the formation.

13. The apparatus of claim 1, wherein the formation comprises an unconsolidated formation.

14. An apparatus for collecting a sample downhole, comprising:

a flow passage extendable up to a formation;

a tube substantially surrounding the flow passage wherein the tube is extendable into the formation;

a drive system in mechanical communication with the tube;

a vibratory source coupled to the tube to enhance penetration;

a sensor in the tool detecting contamination of a fluid sample; and a controller acting under programmed instructions to extend the barrier tube into the formation based on the detected contamination of the fluid sample.

15. A method for reducing contamination of a sample downhole, comprising:

extending a barrier tube into a formation;

vibrating the barrier tube to enhance penetration into the formation sensing a parameter of interest related to contamination of a sample fluid drawn into the tool; and controlling the extension of the tube into the formation in response to the sensed contamination.

16. The method of claim 15, further comprising:

vibrating the tube to enhance penetration into the formation.

17. The method of claim 15, further comprising:

shaping an end of the tube to enhance penetration into the formation.

18. The method of claim 15, further comprising:

rotating the tube to enhance penetration into the formation.

19. The method of claim 15, further comprising:

conveying the tool into the wellbore using at least one of: a wireline, a coiled tubing, and a drill string.

20. The method of claim 15, further comprising:

extending a probe to contact a wall of a formation inside of the barrier tube.

21. The method of claim 20, the method further comprising:

restricting a flow of a contaminated formation fluid toward the probe.

* * * * *